United States Patent [19]

Mugele et al.

[11] 4,225,288

[45] Sep. 30, 1980

[54] PUMP SET COMPRISING A LIQUID RING VACUUM PUMP PRECEEDED BY A COMPRESSOR

[75] Inventors: Kurt Mugele; Bodo Nagel, both of Erlangen, Fed. Rep. of Germany

[73] Assignee: Siemens Aktiengesellschaft, Munich, Fed. Rep. of Germany

[21] Appl. No.: 585,374

[22] Filed: Jun. 9, 1975

[30] Foreign Application Priority Data

Jun. 24, 1974 [DE] Fed. Rep. of Germany ..... 2430314

[51] Int. Cl.[2] ..... F04B 41/06

[52] U.S. Cl. ..... 417/2; 417/28; 417/69; 417/203; 417/247

[58] Field of Search ..... 417/1, 2, 54, 55, 28, 417/47, 65, 66, 68, 69, 85, 201, 203, 247, 248; 415/198 T, 199 T, 213 T, 143

[56] References Cited

U.S. PATENT DOCUMENTS

| | | | |
|---|---|---|---|
| 1,792,741 | 2/1931 | Hayton | 417/68 |
| 2,397,443 | 3/1946 | Statham et al. | 417/2 X |
| 2,492,075 | 12/1949 | Van Atta | 417/2 |
| 3,072,058 | 1/1963 | Christopher et al. | 417/19 |
| 3,221,659 | 12/1965 | Adams | 417/69 |
| 3,315,607 | 4/1967 | MacInnes | 415/198 T |
| 3,359,908 | 12/1967 | Toma | 415/213 T |
| 3,558,236 | 1/1971 | Bylsma | 415/53 T |
| 3,575,532 | 4/1971 | Mugele et al. | 417/69 |
| 3,922,110 | 11/1975 | Huse | 417/243 X |
| 3,973,865 | 8/1976 | Mugele | 415/53 T |

*Primary Examiner*—William L. Freeh
*Assistant Examiner*—Edward Look
*Attorney, Agent, or Firm*—Kenyon & Kenyon

[57] ABSTRACT

A pump set comprising a compressor followed by a liquid ring vacuum pump with the two pumps matched to each other so that a relatively small liquid ring vacuum pump can draw and maintain vacuum under 40 Torr.

3 Claims, 3 Drawing Figures

PUMP SET COMPRISING A LIQUID RING VACUUM PUMP PRECEEDED BY A COMPRESSOR

BACKGROUND OF THE INVENTION

This invention relates liquid ring vacuum pumps in general and more particularly to an improved pump set comprising a liquid ring vacuum pump preceeded by a compressor.

Pump sets consisting of a liquid ring vacuum pump preceeded by a compressor, such as a Roots pump are well known in the art. Devices of this nature are used for suctioning and compressing media in gaseous or vapor form down to a vacuum of 100 Torr. Because displacement pumps such as Roots pumps are relatively complicated in design and require a large amount of maintenance, jet pumps have been used as precompressors in many applications. This is true even though this requires tolerating a larger liquid ring vacuum pump because it must also handle the operating fluid used in the injector pump.

Thus, neither of the methods of implementing such a pump set in the prior art are completely satisfactory. In view of this, it is the object of the present invention to provide an improved pump set of this nature which combines great ruggedness, reliability, small space requirements and has comparatively low power requirements with respect to the intake volumne.

SUMMARY OF THE INVENTION

The present invention solves this problem by using as a compressor preceeding the liquid ring vacuum pump, a side channel ring compressor and by matching suction capacity of the liquid ring vacuum pump to the pressure ratio attainable with the side channel ring compressor.

A side channel ring compressor is the type of compressor or pump disclosed in French Pat. No. 1,382,230, the title of which translates to "Annular Ventilator Based On the Principle Of A Side Channel". Such a device is more commonly known as a regenerative turbine pump and such is disclosed, for example, in U.S. Pat. No. 3,558,236. Examination of that patent will show where the term side channel comes from since the housing of the pump is formed with what are side channels in which the material being pumped circulates.

Through this arrangement the liquid ring vacuum pump need no longer be of sufficient capacity to handle the additional operating medium for an injector pump. As a result, the required total drive power can be considerably reduced and the structural size of the overall pump set made smaller. In accordance with the present invention, means are preferably provided to prevent an impermissable increase of the side channel ring compressor's power consumption when the latter is turned on. One disclosed manner of accomplishing this is by means of controlling the speed of the ring compressor as a function of power consumption, particularly during the starting phase of an evacuation. Power consumption is proportional to the specific gravity of the medium to be compressed and to the pressure difference obtained. Thus, in the simplest case the drive of the liquid compressor is turned on and off in dependence on the pressure. Furthermore, in conjunction therewith it is advantageous to provide a buffer chamber between the ring compressor and the liquid ring vacuum pump to prevent shock-like operations.

Another possible solution which is disclosed comprises providing a return line containing valves controlled as a function of pressure between the pressure side and suction side of the side channel ring compressor. This permits using the line as a bypass for the side channel ring compressor during the starting phase and also permits the return of the pump medium, assuming appropriate throttling, to avoid building up too high a pressure difference in the side channel ring compressor. Since, as noted above, the power of the electric drive of the side channel ring compressor is proportional, among other factors, to the pressure difference and the density, it is also possible to use the current of the electric drive motor to determine power consumption. Then, in dependence on the measured current, the speed and/or current of the drive motor can be limited.

In many applications the drive power may be made pressure dependent through the use of elastic blades in the side channel ring compressor. This is true because, when matched correctly, the elastic blades will permit the buildup of a pressure difference only corresponding to the deliverable motor power.

DETAILED DESCRIPTION OF THE PREFERRED EMBODIMENT

Figure 1:
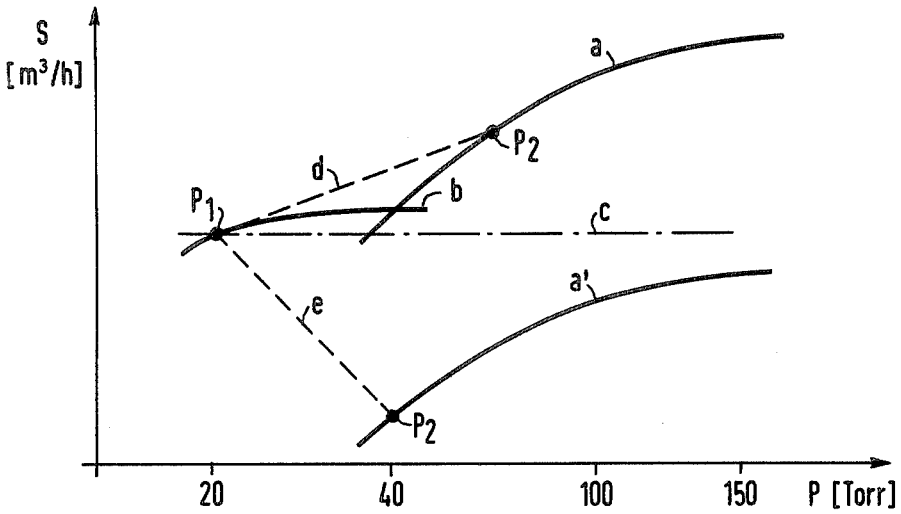
FIG. 1 is a series of curves illustrating the operating characteristics of various combinations of compressors and liquid ring vacuum pumps.

FIG. 1 shows a number of curves helpful in understanding the manner in which the present invention provides a more effective and efficient pump set. On the figure, curve a is a characteristic curve of a liquid ring vacuum pump. On this curve, pressure is plotted against suction capacity. As is evident, suction capacity decreases below 100 Torr due to the evaporation of the liquid ring which typically might be water. To expand the field of application of the liquid ring vacuum pump, a gas jet pump injector can be placed ahead of the liquid ring vacuum pump in well known manner. As a result, for pressures under 40 Torr, for example, the characteristic curve designated b will result for the entire set. During an evacuation the medium to be compressed is then compressed by the jet pump along the line d from the operating point having a pressure $P_1$ to the intermediate pressure $P_2$.

Also plotted on this diagram is the characteristic curve c of a side channel ring compressor in conjection with a liquid ring pump [characteristic curve a']. Assuming that the liquid ring compressor has a compression ratio of 2 to 1, it is evident that at the same initial operating pressure $P_1$ compression to the intermediate pressure $P_2$ takes place along the line e. As a result, a side channel ring compressor can be followed by a liquid ring vacuum pump of considerable suction capacity, i.e. characteristic curve a'. Thus, less drive power is required to obtain the same actual volumetric delivery. As a rough assumption, it can be said that for the compression ratio stated the structural size and thus the capacity of the liquid ring compressor and its power requirements can be cut approximately in half. As a result, a 10% power requirement which is needed in addition for the side channel ring compressor is of no consequence at all in the overall balance.

Figure 2:
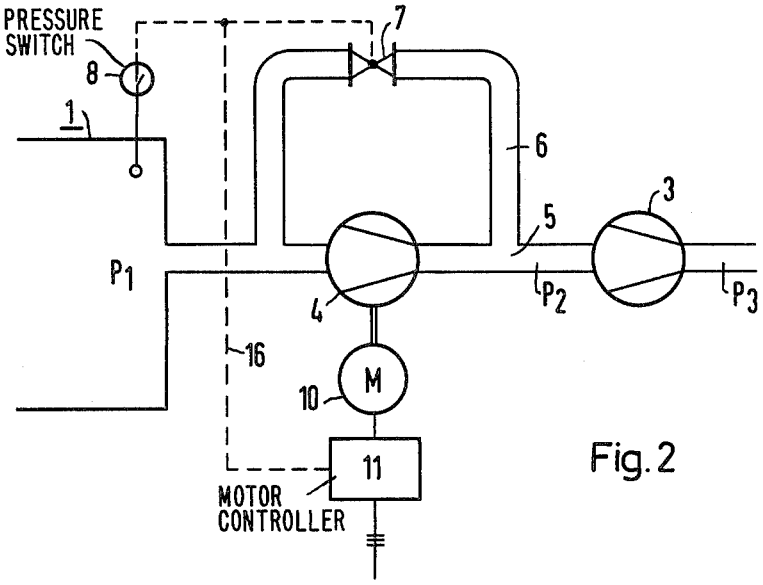
FIG. 2 is a schematic diagram of the present invention.
Figure 3:
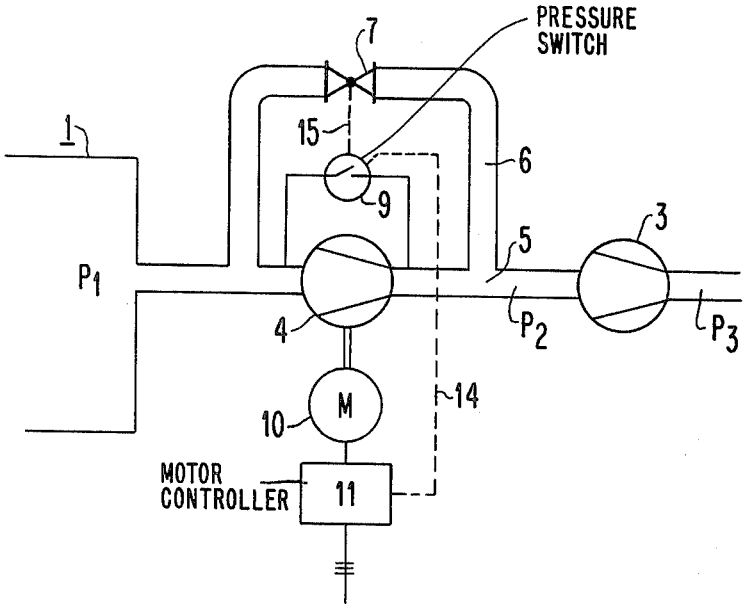
FIG. 3 is a schematic diagram of an alternate embodiment of the present invention.

FIG. 2 is a schematic illustration of the present invention. Shown is a side channel ring compressor 4 connected to a space 1 having a pressure $P_1$ which is to be evacuated. The pressure of side channel ring compressor 4 communicates through a connecting line 5 with the suction side of a liquid ring vacuum pump 3. Liquid ring vacuum pump 3 compresses the pump medium from the intermediate pressure $P_2$ to the output compression pressure $P_3$. This will normally be atmospheric pressure, i.e. approximately 760 Torr. Normally upon starting up the space 1 will be at atmospheric pressure or almost at atmospheric pressure. Under these circumstances, the side channel ring compressor 4 is bypassed by a bypass line 6. Once a sufficient vacuum has been achieved in the space 1, e.g. a vacuum of 40 Torr, a pressure sensor 8 causes a control valve 7 to shut off the bypass line 6 and through a control signal over a line 16 operates a control device 11 to start up the motor 10 driving the side channel ring compressor 4. This avoids in inadmissibly high power consumption for driving the side channel ring compressor. Other means may be provided to do essentially the same thing. For example, as shown on FIG. 3, a pressure sensor in the form of a pressure switch 9 may be installed to measure the differential pressure across the side channel ring compressor 4. This pressure difference is one of the main factors which covers the drive power needed by the drive motor 10. If it exceeds a certain predetermined value an output from the pressure switch 9 over the line 14 acts upon the control device 11 to control the speed of the motor 10. In the simplest case such a signal can be used to switch off the motor until the pressure between the side channel ring compressor and the liquid ring vacuum pump has been sufficiently relieved. Also, as illustrated by a control line 15, the control valve 7 can be driven from the pressure switch 9. Should an inadmissibly high pressure difference result across the side channel ring compressor the valve can be opened to permit a portion of the pump medium to be recirculated.

The side channel ring compressor 4 can also be constructed with flexible, i.e. elastic, blades in its impeller. If the elasticity of these blades is properly selected, they will limit the drive power of the compressor 4 to the level which is permissible.

Further, with regard to the pressure switches 8 and 9 it should be noted that these will be conventional devices providing a switch closure when a preset pressure is reached. The control 11 in its simplest case can simply comprise contactors responsive to these switch closures. The control valve 7 may be a conventional motor controlled valve operable between two limits. In the appropriate cases it too may simply respond to the switch closures provided by the switches 8 and 9.

Thus, an improved pump set for drawing and maintaining vacuums under 40 Torr has been shown. Although specific embodiments have been illustrated and described, it will be obvious to those skilled in the art that various modifications may be made without departing from the spirit of the invention which is intended to be limited solely by the appended claims.

We claim:

1. Apparatus for suctioning off and compressing compressible medium below 100 Torr suction pressure comprising:

(a) a side channel ring compressor having its input coupled to a space from which the media is to be suctioned off;

(b) a liquid ring vacuum having its input coupled to the output of said side channel ring compressor, the suction capacity of said liquid ring vacuum pump being designed for the pressure ratio obtainable by said side channel ring compressor.

2. Apparatus according to claim 1 and further including means to prevent an inadmissible increase of the power consumption of the side channel ring compressor when said ring compressor is turned on.

3. Apparatus according to claim 2 wherein said means to control the speed of the drive comprise means to switch the drive of said side channel ring compressor on and off.

* * * * *